US005112161A

United States Patent [19]

Trevisani

[11] Patent Number: 5,112,161

[45] Date of Patent: May 12, 1992

[54] METHOD FOR EXCAVATING AND CONSTRUCTING MONOLITHIC CONTINUOUS STRAIGHT OR CIRCULAR STRUCTURAL WALLS AND A MACHINE FOR REALIZING SUCH A METHOD

[75] Inventor: Davide Trevisani, Cesena, Italy

[73] Assignee: Trevi S.p.A., Cesena, Italy

[21] Appl. No.: 549,609

[22] Filed: Jul. 9, 1990

[30] Foreign Application Priority Data

Jul. 10, 1989 [IT] Italy ..... 3550 A/89
Jul. 10, 1989 [IT] Italy ..... 3551 A/89

[51] Int. Cl.[5] ..... E02D 5/20

[52] U.S. Cl. ..... 405/267; 405/229; 37/192 A; 172/447

[58] Field of Search ..... 405/55, 222, 223, 229, 405/258, 266, 267, 268, 287, 180–183; 37/80 R, 83, 86, 87, 191 A, 192 A; 172/447, 448, 477, 742, 739, 740

[56] References Cited

U.S. PATENT DOCUMENTS

| | | | |
|---|---|---|---|
| 3,022,585 | 2/1962 | Bradley | 37/86 |
| 3,140,745 | 7/1964 | Hinkle et al. | 405/181 X |
| 3,893,302 | 7/1975 | Peterson | 405/267 |
| 4,119,157 | 10/1978 | Schuck et al. | 172/477 |
| 4,379,658 | 4/1983 | Schmednecht | 405/267 |
| 4,430,022 | 2/1984 | Kinnan | 405/183 |
| 4,861,199 | 8/1989 | Hackmack | 405/267 |
| 4,871,281 | 10/1989 | Justice | 37/83 X |

FOREIGN PATENT DOCUMENTS

| | | | |
|---|---|---|---|
| 3604736 | 2/1986 | Fed. Rep. of Germany . | |
| 3740156 | 2/1989 | Fed. Rep. of Germany | 405/267 |
| WO85/04210 | 9/1985 | PCT Int'l Appl. . | |
| 1134663 | 1/1985 | U.S.S.R. | 405/268 |

*Primary Examiner*—Dennis L. Taylor
*Assistant Examiner*—John Ricci
*Attorney, Agent, or Firm*—Bachman & LaPointe

[57] ABSTRACT

An equipment for excavating and constructing straight or circular continuous monolithic structural walls, comprises a motor driven vehicle provided with a support structure for substaining a beam which is orientable about a vertical and horizontal axis, a slide on one side of the beam, an excavator mounted onto the slide and comprising a chain that is substantially vertical in an operative position, a framework provided with vibrators and carried by the slide following the excavator and a hose meant to convey concrete following the excavator inside the excavation.

5 Claims, 2 Drawing Sheets

METHOD FOR EXCAVATING AND CONSTRUCTING MONOLITHIC CONTINUOUS STRAIGHT OR CIRCULAR STRUCTURAL WALLS AND A MACHINE FOR REALIZING SUCH A METHOD

BACKGROUND OF THE INVENTION

The present invention is drawn to a method for excavating and constructing monolithic continuous straight or circular structural walls and an equipment for carrying out the method.

A method is already known in the prior art which consists of digging a trench for the structural wall, substaining the walls of the trench by introducing mixtures, usually with bentonite, and then inserting a diaphragm made of adjacent prismatic elements with a rectangular section.

The main drawback of such a technique is that the elements of the diaphragm, being simply put near each other, do not guarantee a safe hydraulic sealing nor the complanarity of the various elements. The foregoing results in settings when underground stresses occur.

Moreover, when the walls of the trench are kept up by bentonitic mixtures, several yard equipment, usually very bulky, are required for making and storing the bentonite mixtures.

A further problem occurs when the excavated soil is polluted with bentonite. Dumps are needed together with transportation means provided with watertight dump boxes to dispose of the soil.

The foregoing technique is not only used for executing straight stuctural concrete walls, but also for realizing wells and therefore structural walls with a circular shape. In this second case the method consists in executing, along the circumference of the wall, a sequence of reinforced concrete diaphragms. Such diaphragms are casted into trenches that are substained by bentonitic mixtures.

The diaphragms are mainly executed in sequences, with opening and closing diaphragms alternatively fitted.

The main drawback of this excavating technique is that the diaphragms are never perfectly vertical, so that it is impossible to execute a structural junction between the single diaphragms. So a further problem is that such diaphragms guarantee the well to be functional only down to the level where they are perfectly positioned along the circumference of the wall.

At deeper levels, due to the misalignment with the vertical line, the diaphragms work as isolated elements in the ground, being stressed by bending and shearing stresses.

SUMMARY OF THE INVENTION

The object of the present invention is to overcome the above deficiences by proposing a method and equipment that allow placement of diaphragms with various thicknesses in a junction free manner in any kind of ground. Such diaphragms may be straight or circular, and in the second case they are made for executing large diameter wells, overcoming the problems that the techniques known up to now have experienced. This object is realized by executing continuous circular concrete walls that keep vertical for a greater depth guaranteeing the structure to work as a well.

The objects are obtained according to the invention by realizing a circular structural wall for large diameter well excavations by means of an equipment for excavating and constructing straight or circular continuous monolithic structural walls, characterized by the fact that it comprises a motor driven vehicle provided with means for substaining a beam which is orientable about a vertical and horizontal axis, a slide on one side of said beam, an excavator mounted onto said slide and comprising a chain that is substantially vertical in an operative position, framework means provided with vibrators and carried by said slide following said excavator and a hose meant to convey concrete following the excavator inside the excavation.

DETAILED DESCRIPTION OF THE DRAWINGS

Other characteristics and benefits of the invention will be evident in the following description of a preferred but not restrictive embodiment of the equipment and of the method, which are both shown in the annexed drawings, wherein.

DETAILED DESCRIPTION

Figure 1:
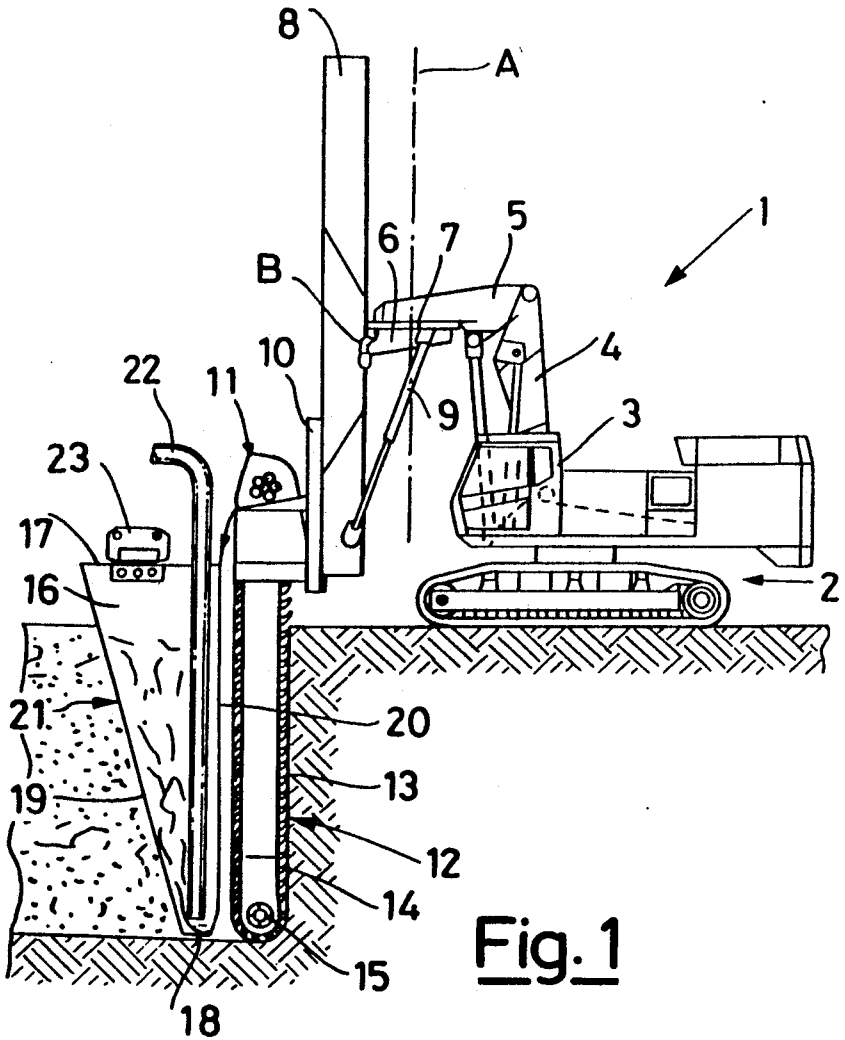
FIG. 1 is a side view of the equipment that is used to carrying out the method according to the invention.

Referring first to FIG. 1, a motor driven crawler track equipment, indicated as a whole with reference number 1, is used for carrying out the method in accordance with the invention.

The equipment 1 comprises a motor driven truck provided with crawler tracks and with an operator's workstation 3.

Equipment 1 also comprises a column 4 provided with a boom 5 mounted overhanging to which a rotable bracket 6 is connected by means of a thrust bearing 7 rotating around a vertical axis A.

Bracket 6 supports a beam 8 that can oscillate around point B in a vertical plane.

The orientation of beam 8 is accomplished by means of an hydraulic jack 9 having its cylinder fixed to bracket 6 and its piston rod pivotally connected to the lower end of beam 8.

A slide 10 is mounted on the side of beam 8 which is opposite to the side with the articulated joint: said slide 10 holds a work head unit 11 for the excavator 12. Excavator 12 comprises a chain 13 carrying buckets or picks 14 and it extends itself between a top driving pulley and a driven sheave 15. The ascending part of chain 13 is parallel to the descending part, so to dig a rectangular trench.

A couple of parallel plates 16 are fitted one on each side of excavator 12. Plates 16 have the shape of an upside down right-angled trapezium wherein the longer base 17 and the shorter base 18 are united by oblique side 19 and by the side 20 which is perpendicular to both bases.

The framework 21 comprises plates 16 and excavator 12 which define an excavated area; in the area a hose 22 is inserted which goes down along chain 13, and through this hose the concrete is casted into the area.

One or more vibrators 23, meant for compacting the casted concrete, are mounted onto the longer bases 17 of plates 16.

The concrete may be prepared and transported nearby the place where the wall has to be casted, by means of a truck mixer 24, connected by a flexible hose 25 to hose 22.

A pump 26 is provided for a better conveyance of the concrete from truck mixer 24 to hose 22.

Figure 2:
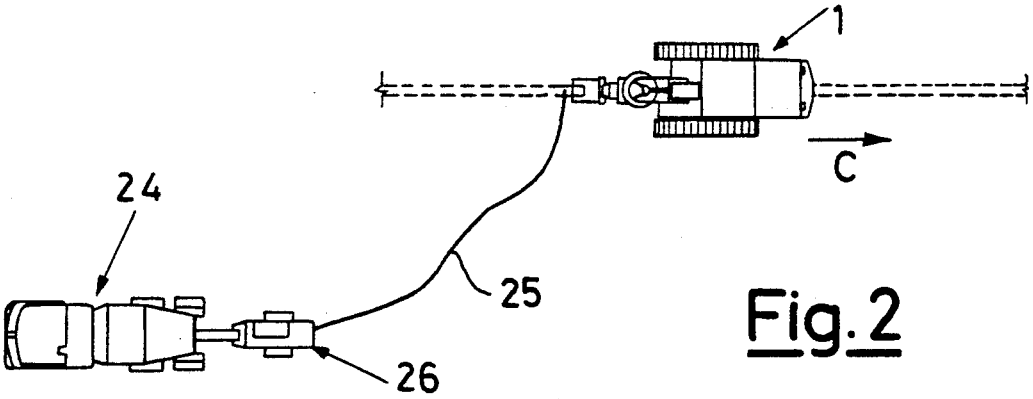
FIGS. 2 and 3 are both plans showing the equipment according to the invention in two different operating conditions.

The method for casting a continuous monolithic structural wall, substantially straight as shown in FIG. 2, is carried on as follows. The excavator 12 is positioned above the extremity of the structural wall to be built and so it is got to slide down along boom 8 and penetrate vertically into the ground, digging a hole as deep as the wall. After the excavator has been advanced for a short bit, the formwork 21 is slipped into the trench and it is fixed to the excavator in such a way that the shorter base 18 is level with sheave 15.

The tube 22 is inserted from the top into the formwork 21, tube 22 is connected, with the outlet of cement pump 26 by means of flexible hose 25, which is fed by truck mixer 24.

The equipment 1, by moving continuously and constantly in direction C, realizes a continuous trench wherein the walls are substained by formwork 21, and in which the concrete is conveyed and opportunely compacted by the action of vibrators 23 for a better setting and hardening. The process goes on this way until the whole length of the structural wall is realized.

Figure 3:
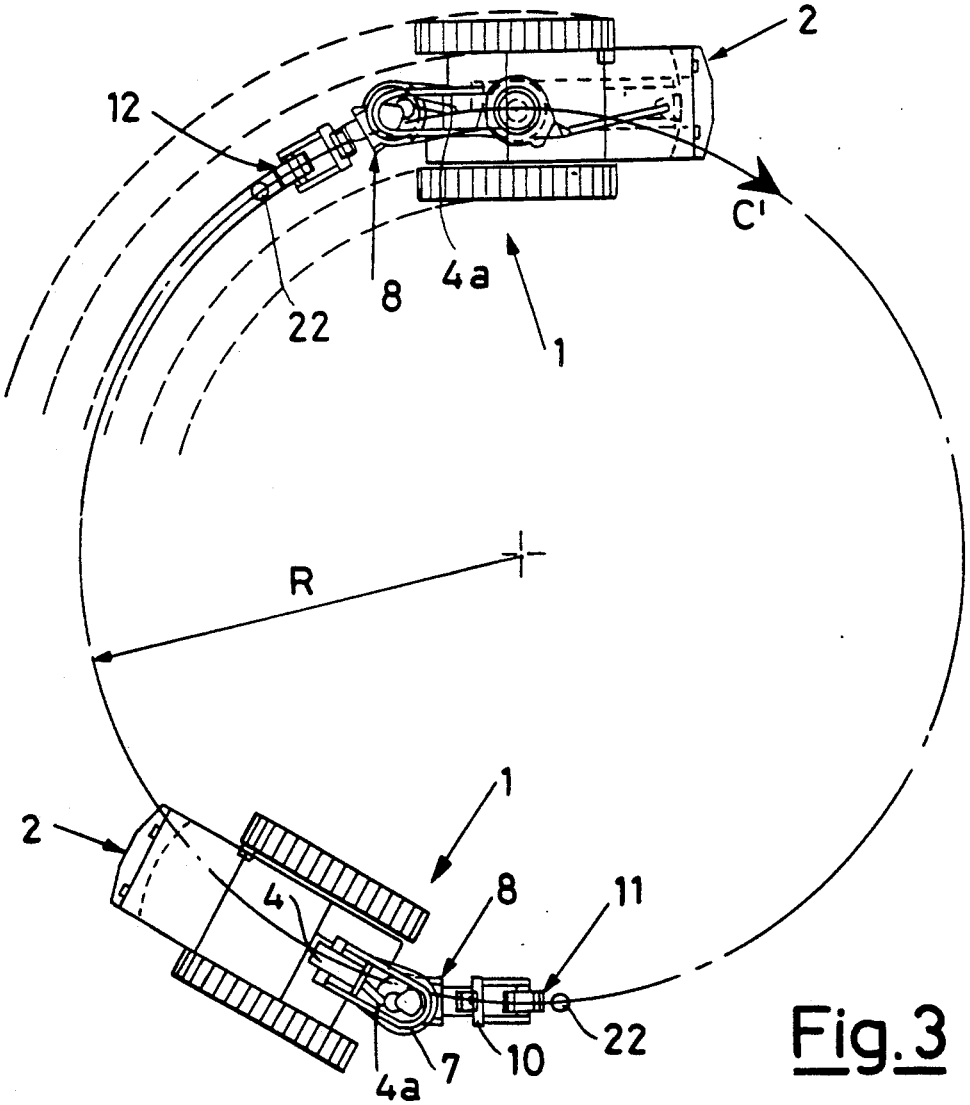

The process for excavating and constructing a circular structural wall for the realization of large diameter walls, like the one in FIG. 3, is brought on as follows.

The excavator 12 is located in a position tangential to the hypothetical circumference of the well that is going to be dug. Then it is slided down along beam 8 and it is forced to penetrate vertically into the ground digging a hole as deep as the well.

The excavator is then forced to move horizontally for a short bit and then the hose 22 is inserted in the hole following chain 13 and parallel to it.

A circular trench is executed by driving the equipment in direction C' and by rotating opportunely the excavator 12 round vertical axis A; the concrete 22 is conveyed through hose 22 into the trench, and such operations go on unitl the whole circular structural wall is completed.

Once the structural wall is finished, the soil inside the wall may be excavated down to the depth of the wall.

The process hereby described allows to realize circular wells in non reinforced concrete about 40 cm thick and 10 m deep.

Figure 4:
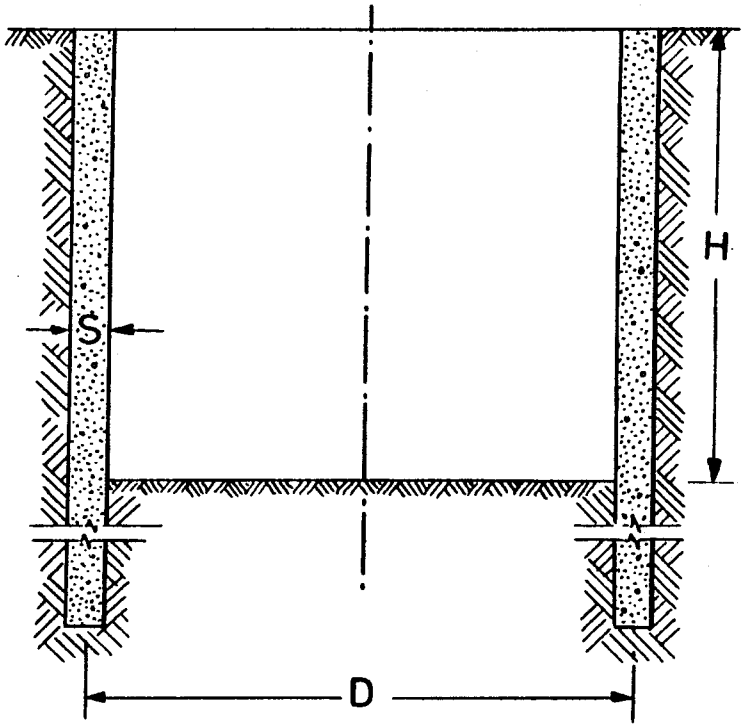
FIG. 4 is a lengthwise diametral section of a well that has been excavated with the method according to this invention.

As it can be observed in FIGS. 3 and 4, the well has a diameter D, an excavated deepeness H and a thickness S of the wall.

I claim:

1. A device for the simultaneous excavation and construction of straight and curved continuous monolithic structural walls comprising:

a motor driven vehicle, said motor driven vehicle having first pivoting means for supporting a bracket member therefrom for rotational movement about a vertical axis A;

support means mounted on said bracket member and including second pivoting means for supporting a beam member therefrom for oscillating movement in a vertical plane about a point B;

a slide member mounted for vertical movement on said beam;

excavator means movably mounted on said slide member for excavating material from an area;

plate means carried by said slide member and extending beyond either side of said excavator means so as to define therewith an excavated area;

vibrating means associated with said plate means; and concrete delivery means for delivering concrete to said excavated area for forming said structural wall.

2. A device according to claim 1 wherein said plate means comprises a pair of upside down right-angled trapezium shaped plates having an upper longer side and a lower substantially parallel lower base wherein the lower base reaches the depth of the lower end of the excavator.

3. A method for the simultaneous excavating and construction of straight and curved continuous monolithic structural walls in ground comprising:

providing a motor driven vehicle having a vertically disposed excavator means vertically movable thereon;

positioning said excavator means vertically in the ground at a desired depth;

advancing the vehicle a distance X so as to form a longitudinal trench by means of said excavator means;

introducing side wall means into said trench on either side of said excavator means wherein an excavated area is defined by said excavator and side wall means in the trench;

fixing said side wall means to said excavator means;

locating cement feed means within said excavated area; and simultaneously advancing said vehicle and feeding cement to said cement feed means so as to form a wall.

4. A method according to claim 3 including the steps of pivoting said excavator means about its vertical access to form a curved wall.

5. A method according to claim 3 including the steps of vibrating said side wall means during the feeding of cement.

* * * * *